US009387981B2

(12) United States Patent
Meijers et al.

(10) Patent No.: US 9,387,981 B2
(45) Date of Patent: Jul. 12, 2016

(54) COLLAPSIBLE TRANSPORT CONTAINER

(71) Applicant: Holland Container Innovations B.V., Delft (NL)

(72) Inventors: Arthur Vincent Marius Meijers, Rotterdam (NL); Rober Anthonius Buskermolen, Amsterdam (NL)

(73) Assignee: Holland Container Innovations B.V. (NL)

( * ) Notice: Subject to any disclaimer, the term of this patent is extended or adjusted under 35 U.S.C. 154(b) by 79 days.

(21) Appl. No.: 13/738,181

(22) Filed: Jan. 10, 2013

(65) Prior Publication Data

US 2013/0180981 A1 Jul. 18, 2013

(30) Foreign Application Priority Data

Jan. 16, 2012 (NL) ..... 2008125

(51) Int. Cl.
*B65D 88/52* (2006.01)
*B31B 1/26* (2006.01)
*B65D 6/18* (2006.01)

(52) U.S. Cl.
CPC ..... *B65D 88/522* (2013.01); *B31B 1/26* (2013.01); *B65D 11/1833* (2013.01); *B65D 88/52* (2013.01)

(58) Field of Classification Search
CPC .... B65D 88/12; B65D 88/522; B65D 88/524; B65D 88/52; B65D 11/18; B65D 11/184; B65D 11/1833
USPC ..... 220/1.5, 4.28, 6, 7, 666
See application file for complete search history.

(56) References Cited

U.S. PATENT DOCUMENTS

| | | | | | |
|---|---|---|---|---|---|
| 844,955 | A * | 2/1907 | Morgan | 220/8 |
| 3,570,698 | A * | 3/1971 | Dougherty | 220/1.5 |
| 3,612,330 | A * | 10/1971 | Baer | 220/1.5 |
| 3,735,713 | A * | 5/1973 | Glassmeyer | 108/53.5 |
| 4,214,669 | A * | 7/1980 | McQuiston | 220/6 |
| 4,546,896 | A * | 10/1985 | Reid | 220/4.28 |
| 4,577,772 | A * | 3/1986 | Bigliardi | 220/1.5 |
| 4,848,618 | A * | 7/1989 | Yuan et al. | 220/1.5 |
| 5,107,639 | A * | 4/1992 | Morin et al. | 52/71 |
| 5,190,179 | A * | 3/1993 | Richter et al. | 220/6 |
| 5,509,559 | A * | 4/1996 | Okano et al. | 220/1.5 |
| 7,240,799 | B2 * | 7/2007 | Zhang | 206/600 |
| 7,793,599 | B2 * | 9/2010 | Truksa | 108/145 |

(Continued)

FOREIGN PATENT DOCUMENTS

| | | |
|---|---|---|
| DE | 954677 B | 12/1956 |
| FR | 2699513 A1 | 6/1994 |

(Continued)

OTHER PUBLICATIONS

NL 2008125 Search Report and Written Opinion dated Sep. 12, 2012 (10 pages).

(Continued)

*Primary Examiner* — Stephen Castellano
(74) *Attorney, Agent, or Firm* — Edmonds & Nolte, PC

(57) ABSTRACT

A collapsible transport container 302 comprising: a base 304; a roof 310; a side wall 306 rotatable relative to the base 304; and a linkage 311 operably connecting the wall 306 to the roof 310, the connecting linkage 311 comprising a first rigid link 316 rotatably connected at one end to the wall 306 and a second rigid link 318 rotatably connected to the other end of the first rigid link 316 and rotatably connected to the roof 310.

20 Claims, 12 Drawing Sheets

(56) References Cited

U.S. PATENT DOCUMENTS

| | | | | |
|---|---|---|---|---|
| 7,882,973 | B2 * | 2/2011 | Krohn | 220/1.5 |
| 7,931,164 | B2 * | 4/2011 | Krohn | 220/7 |
| 7,984,819 | B1 * | 7/2011 | Davis | 220/4.28 |
| 8,573,433 | B2 * | 11/2013 | Kochanowski | 220/666 |
| 2008/0029510 | A1 * | 2/2008 | Fisk | 220/7 |
| 2008/0121188 | A1 * | 5/2008 | Axelrod | |
| 2008/0135545 | A1 * | 6/2008 | Sadkin et al. | 220/1.5 |
| 2010/0025397 | A1 * | 2/2010 | Krohn | 220/6 |
| 2014/0144920 | A1 * | 5/2014 | Meijers et al. | 220/666 |

FOREIGN PATENT DOCUMENTS

| | | | |
|---|---|---|---|
| JP | H0516694 | U | 3/1993 |
| NL | 1017159 | C2 | 7/2002 |
| WO | 9414684 | | 7/1994 |
| WO | 2009038518 | A1 | 3/2009 |

OTHER PUBLICATIONS

DE Examination Report dated Jun. 16, 2014 (5 pages).

* cited by examiner

COLLAPSIBLE TRANSPORT CONTAINER

CROSS-REFRENCE TO RELATED APPLICATIONS

This application claims priority to Netherlands application number 2008125, which was filed on Jan. 16, 2012.

FIELD OF INVENTION

This invention relates to a collapsible transport container comprising a base, a roof, a side wall rotatable relative to the base, and a linkage operably connecting the wall to the roof,

BACKGROUND

Containers of the type disclosed in NL1017159 are employed across the globe for the transport of freight goods, by land, sea and air. Global trade and distribution imbalances frequently necessitate the transport of empty containers from large consumption markets to regions of mass production and manufacture. In order to alleviate the cost of transporting empty containers, collapsible containers have been developed. These containers can be folded when empty into a collapsed or stowed condition in which they occupy significantly less volume than in their assembled or erected condition, thus allowing for more efficient transportation of the containers when empty.

Assembly and disassembly of collapsible containers must take place in a safe and reliable manner. Frequently, the size and weight of the container walls are such that heavy lifting equipment such as forklifts must be employed, complicating operation and increasing the burden of assembly/disassembly. It is therefore desirable to simplify as far as possible the procedure for assembly and disassembly of collapsible containers. One known type of collapsible container 102 is illustrated in FIGS. 1*a* to 1*c* and comprises a base 104, side walls 106, 108 and a roof 110. The walls 106, 108 are hinged to the base 104 at hinges 112, 114 such that they may rotate about the hinges and fold onto the base 104. The roof 110 is connected to the opposed side walls 106, 108 via rigid connection members 116, 118, each of which is connected via a first hinge 124, 126 to a respective side wall 106, 108 and via a second hinge 120, 122 to the roof 110. The connection members may thus pivot about each end, allowing for raising of the roof 110, pivoting motion of the walls 106, 108 beneath the roof 110 and then lowering of the roof 110 onto the collapsed walls 106, 108, as illustrated particularly in FIG. 1*b*. The connection members allow a connection to be maintained between the side walls 106, 108 and the roof 110, during the process of collapsing the walls.

FIG. 1*c* illustrates the structure of the collapsible container in more detail. It will be appreciated that, during collapsing of the walls 106, 108, the connection members 116, 118 must pass through an angle approaching 270° with respect to the walls 106, 108. In order to allow for this range of motion, it is necessary to leave large recesses 117 in the top of each wall (106,108) or roof (110), and these recesses 117 impact on the ability to seal the joint between the walls and the roof. In practice, it is extremely difficult to establish a seal between the roof 110 and walls 106, 108, while leaving the necessary clearance, and consequently, the container 102 cannot be made watertight. This is a considerable disadvantage as if sea water enters the container 102 in high seas, the contents of the container can be seriously damaged.

Another known container type that seeks to address the issue of sealing between the roof and walls of the container is illustrated in FIGS. 2*a* and 2*b*. This container 202 also comprises a base 204, opposed side walls 206, 208 and a roof 210. The walls 206, 208 are hinged to the base 204 at hinges 212, 214 such that they may rotate about the hinges and fold onto the base 204. The roof 210 is connected to the opposed side walls 206, 208 via rigid connection members 216, 218. Each connection member comprises a first end which is connected via a first hinge 224, 226 to a respective side wall 206, 208. The second ends of the connection members 216, 218 are formed as runners 230, 232, adapted to be slidably received within a respective slot or channel 234, 236 formed on the roof 210. According to this construction, it is possible to lift the roof 210, pivot the side walls 206, 208 towards the base 204 and subsequently lower the roof 210 without the need for excessive pivoting of the connection members 216, 218. The connection members merely slide within the slots 264, 236 formed within the roof 210. Owing to this sliding motion, the container can be constructed without the need for large clearance between the walls 206, 208 and the roof 210, and a watertight seal may be obtained between the walls 206, 208 and the roof 210. A further example of a collapsible container of this type is disclosed in FR2699513

Although the container of FIG. 2 addresses some of the clearance and sealing issues experienced with the container of FIG. 1, other issues of assembly and disassembly are known to arise with this type of container. In order to accommodate the motion required for assembly, the slot and slider system must be relatively long and complex. In addition, it is necessary to maintain the roof in accurate alignment with the base during assembly and disassembly of the container. Misalignment of the roof with respect to the rest of the container can cause the slider mechanisms to jam during motion, placing excessive forces on the slider joints. In practice, it is extremely difficult to maintain accurate alignment of the roof when lifting, for example with a reach stacker or a crane. The connection members, sliders and hinges must therefore be highly robust to withstand the large loads experienced during assembly and disassembly of the container. Even with extremely robust connections, a trained operator is required and there remains a risk that the connections between the connection members and the roof or the walls may fail.

Japanese patent publication JP H05 16694 U describes a foldable pallet container. This publication discloses a different method of folding compared to the above publications and to the present invention. Side walls need to be totally removed before folding and the roof is directly fixed to the side walls at its upper end and via a linkage.

This invention seeks to address some or all of the above mentioned disadvantages associated with known collapsible transport containers according to NL1017159 and FR2699513.

SUMMARY OF THE INVENTION

According to the present invention, there is provided a collapsible transport container comprising a base, a roof, a side wall rotatable relative to the base, and a linkage operably connecting the wall to the roof, the connecting linkage comprising a first rigid link rotatably connected at one end to the wall and a second rigid link rotatably connected to the other end of the first rigid link and rotatably connected to the roof.

The first and second rigid link may be connected by means of a hinge.

The roof may be connected to two opposed side walls via the connecting linkage allowing for raising the roof, inward pivoting motion of the side walls towards the base and beneath the roof and then lowering the roof onto the collapsed side walls.

The collapsible transport container may further comprise two elongated and opposed walls hinged to the base and inwardly rotatable towards the base, which walls have a greater length than the side walls connected to the roof.

The first and/or second link may be provided with a recess which is shaped to accommodate a top of the side wall when the container is in a collapsed condition.

The first rigid link may be provided with the recess.

The first and/or second rigid link may be bent, the recess being defined by the concave side of the bent rigid link.

The recess as present in the first and/or second rigid link may be L-shaped, the recess being defined between the limbs of the L-shaped rigid link. Alternatively, the first and/or second rigid link may be arcuate, the recess being defined by the concave side of the arcuate rigid link.

The first rigid link may be attached to a bracket fixed to an inner side of the wall. The point at which the first rigid link attaches to the bracket may be above a top surface of the wall. The second rigid link may then not require a recess and may be substantially straight.

A means to limit the rotation of the first rigid link relative to the second rigid link is preferably provided. Such a means may for example be an asymmetrical axis or suitably a member fixed to one of the first and second rigid links and suitably overlapping the other of the first and second rigid links. The limiting member may act to limit the range of movement of the first rigid link relative to the second rigid link. The limiting member may comprise a plate or bracket welded to the first or second rigid link.

The connecting linkage may connect to the roof at a fixed location. The connecting linkage may connect to the roof via a hinge. Alternatively, the connecting linkage may connect to the roof via a sliding connection.

The first and/or second rigid link may comprise a metallic rod or tube.

Each rotatable connection may be provided by a hinge, which may for example comprise a pinned joint.

The invention is also directed to a method to fold a collapsible container as described above by lifting the roof from the side wall, wherein the side wall or side walls pivot inwardly towards the base and subsequently lowering the roof resulting in that the side wall or side walls further pivot towards the base.

The method may also be performed using the collapsible transport container further comprising two elongated and opposed walls hinged to the base and inwardly rotatable towards the base, which walls have a greater length than the side walls connected to the roof. In this method these two elongated and opposed walls are in turn first pivoted inwardly towards the base before lifting the roof.

In this specification descriptive terms such as upper, lower, upward, downward, above and below are all described in relation to an assembled container resting on its base, and the term inwardly means towards the interior of the container. The various brackets described below may be fixed to the components of the container in any conventional manner, such as by welding or bolting. In addition, the term hinge is to be interpreted broadly to cover any jointing arrangement, such as a conventional pinned joint with or without bushes or bearings.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 3A:
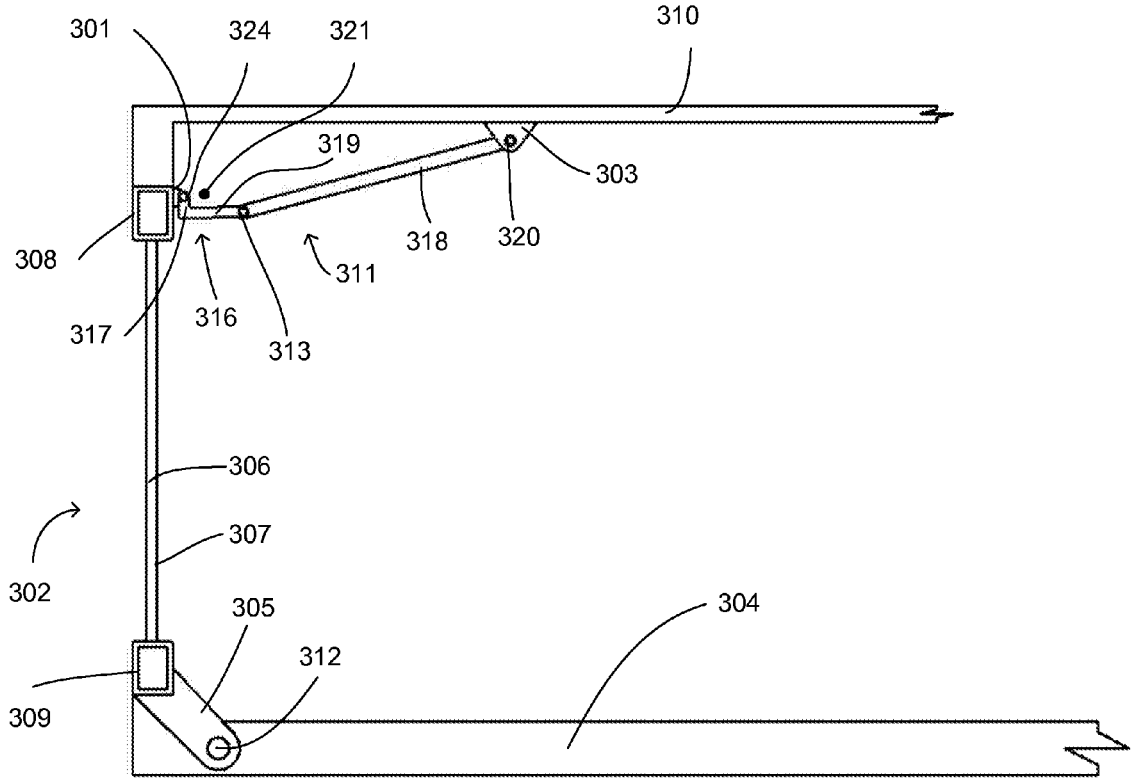
FIG. 3*a* illustrates an assembled container having a connecting linkage according to a first embodiment of the present invention.

With reference to FIGS. 3*a*, a collapsible container 302 comprises a base 304, side walls 306 (only one of which is illustrated) and a roof 310. The walls 306 are hinged to the base 304 by hinges 312 such that they may rotate about the hinges and fold onto the base 304. The hinges 312 thus define axes of rotation for the walls 306.

Each wall 306 comprises a planar portion 307 which extends between upper and lower tubular members 308, 309. The lower tubular member 309 is provided with a first inwardly and downwardly projecting bracket 305 which is hinged to the base 304 and supports the wall 306 above the base 304. Alternatively such a downwardly projected bracket may be connected to a vertical member running along the side of the wall. The roof 310 is connected to each side wall 306 by a respective connecting linkage 311, which comprises a first rigid link 316 connected to a second rigid link 318 by means of a hinge 313. Preferably each side wall 306 is connected to the roof 310 by means of two connecting linkages, each positioned at the opposite end of the upper end of the side wall. The resulting four connecting linkages are connected to the 4 corners of the roof by means of, for example, the connections illustrated in FIGS. 4-6. Each first rigid link 316 is connected by a hinge 324 to a respective second bracket 301 fixed to a side wall 306, and each second rigid link 318 is connected by a hinge 320 to a respective third bracket 303 fixed to the roof 310.

The first rigid link 316 is substantially L-shaped and comprises a first limb 317 which projects substantially at right angles from the end of a second limb 319. A recess 321 is defined between the limbs 317, 319. The first and second rigid links 316, 318 are formed from any appropriate rigid material and may comprise for example a metallic tube, channel or bar.

Figure 3B:
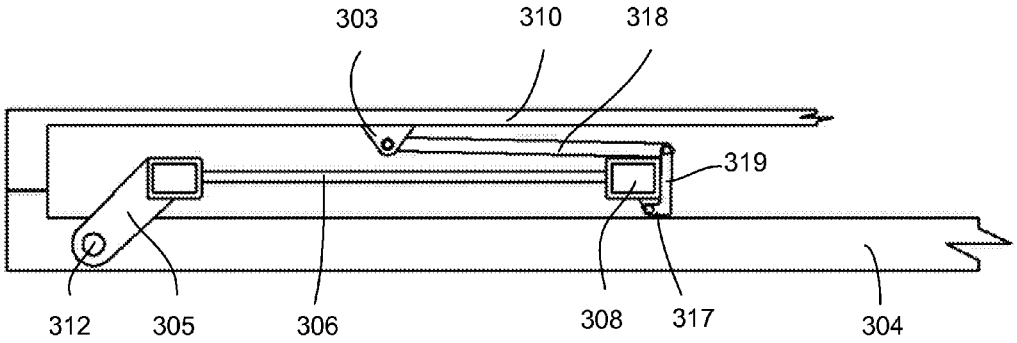
FIG. 3*b* illustrates the container of FIG. 3*a* in a collapsed condition.

In order to collapse the container from an assembled condition, the roof 310 is lifted slightly from the walls 306, to allow the walls 306 to be pivoted about the hinges 312 towards an interior of the container. As the walls 306 collapse inwards, the roof lowers onto the collapsed walls 306 as illustrated in FIG. 3*b*.

In the collapsed configuration, the roof 310 directly abuts the base 304 at its periphery, and the walls 306 are stowed between the roof 310 and the base 304. As the recess 321 defined by the first rigid link 316 is sized to accommodate the upper tubular member 308 of the wall 306, the first rigid link 316 does not foul the side wall 306 as it folds down, and the second rigid link 318 is positioned just above the wall 306 in the collapsed configuration. The same result can be achieved using a bent or arcuate first rigid link 316 (not shown) to provide the necessary recess to clear the upper tubular member 308 in the fully collapsed condition.

Figure 1A:
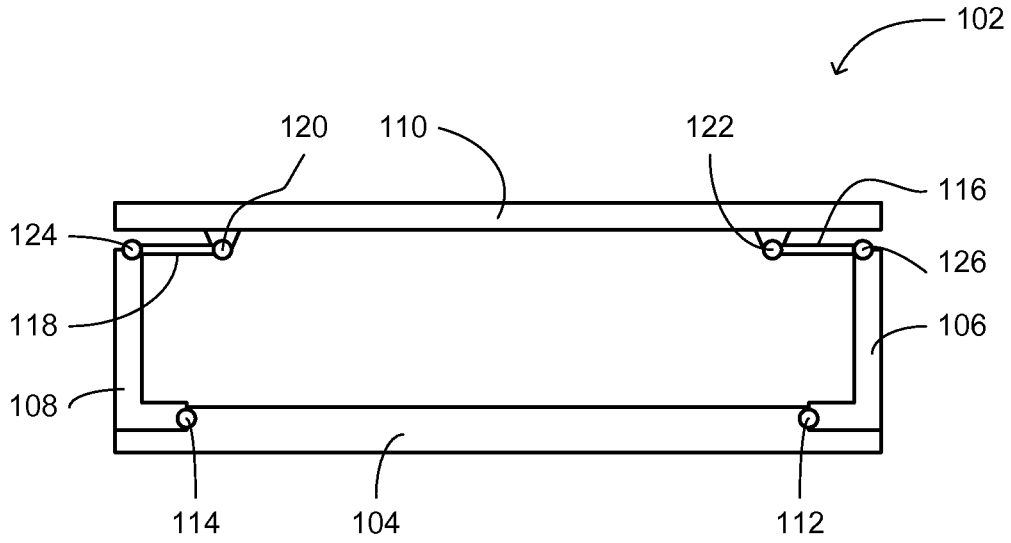
FIGS. 1*a* to 1*c* illustrate a collapsible container according to the prior art.
Figure 1B:
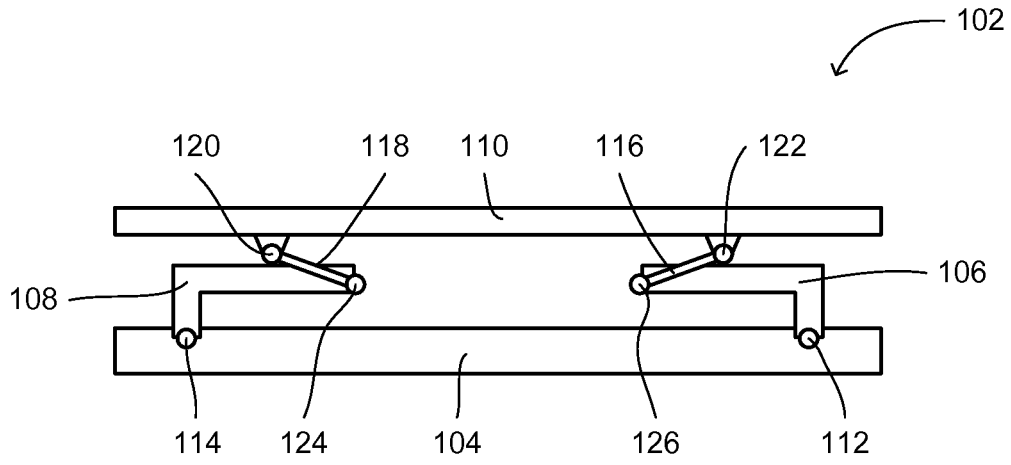
Figure 1C:
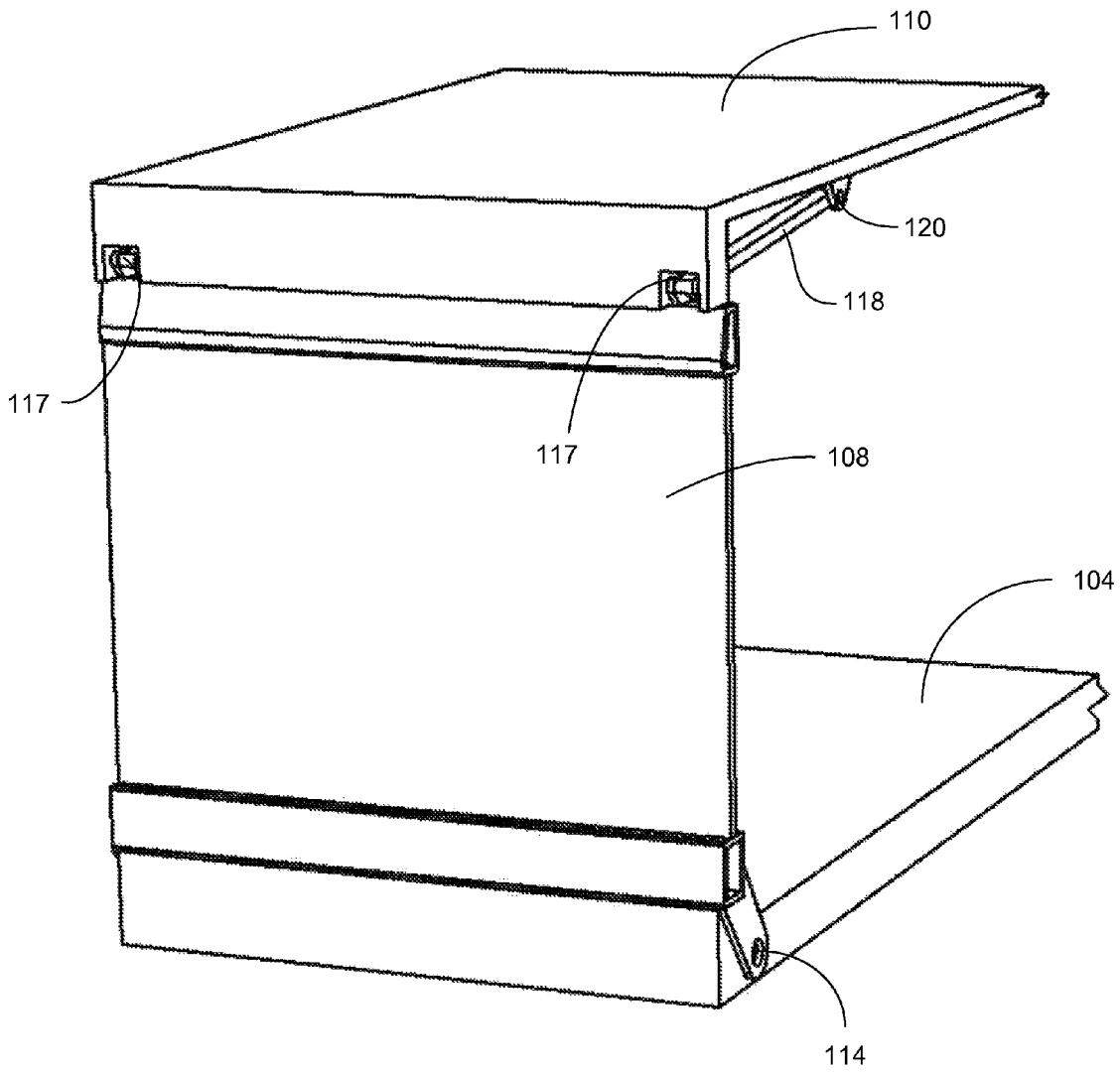
Figure 2A:
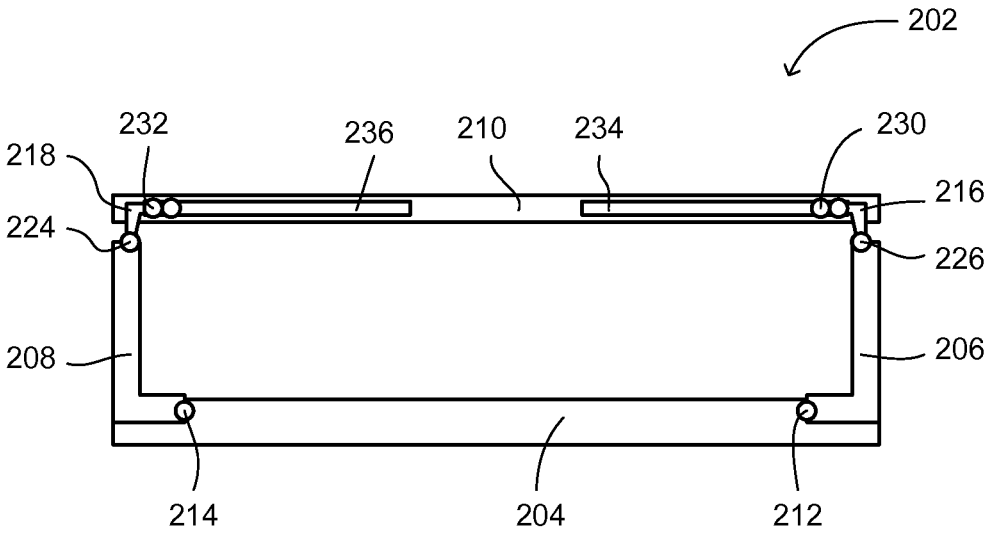
FIGS. 2*a* and 2*b* illustrate another collapsible container according to the prior art.
Figure 2B:
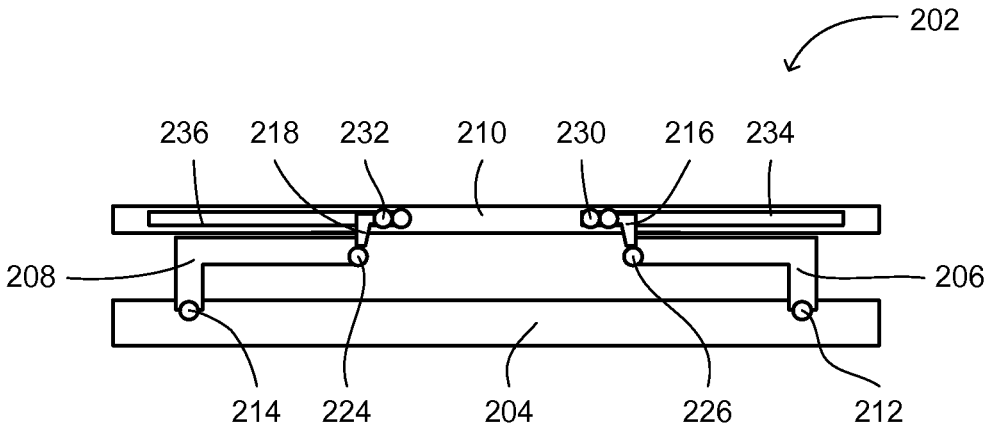

By using a linkage comprising a first rigid link 316 and a second rigid link 318, the large recesses 117 in the prior art arrangement illustrated in FIG. 1*c* are no longer required. As mentioned above, these recesses 117 interfere with the proper sealing between the walls 306 and the roof 310 and introduce structural weakness. As these recesses 117 can be avoided according to the present invention, the container 302 is both stronger and more watertight than the prior art containers.

Figure 3C:
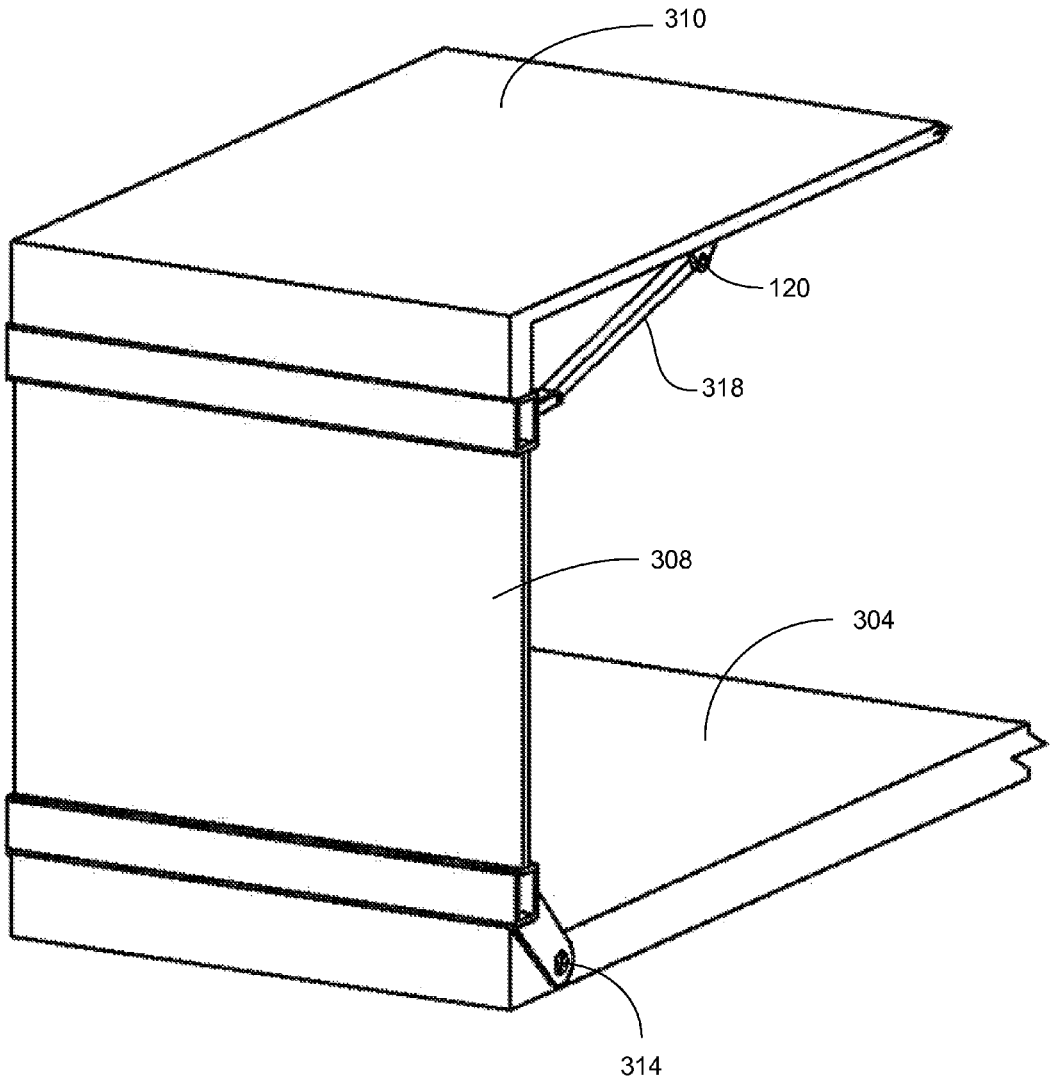
FIG. 3*c* illustrates container of FIG. 3*a*.

FIG. 3*c* shows the container of FIG. 3*a* in a 3D-view. It is clear that less sealing is required to close any openings for this container as compared to the container according to the prior art shown in FIG. 1*c* which does have large recesses which require a sealing.

Figure 4A:
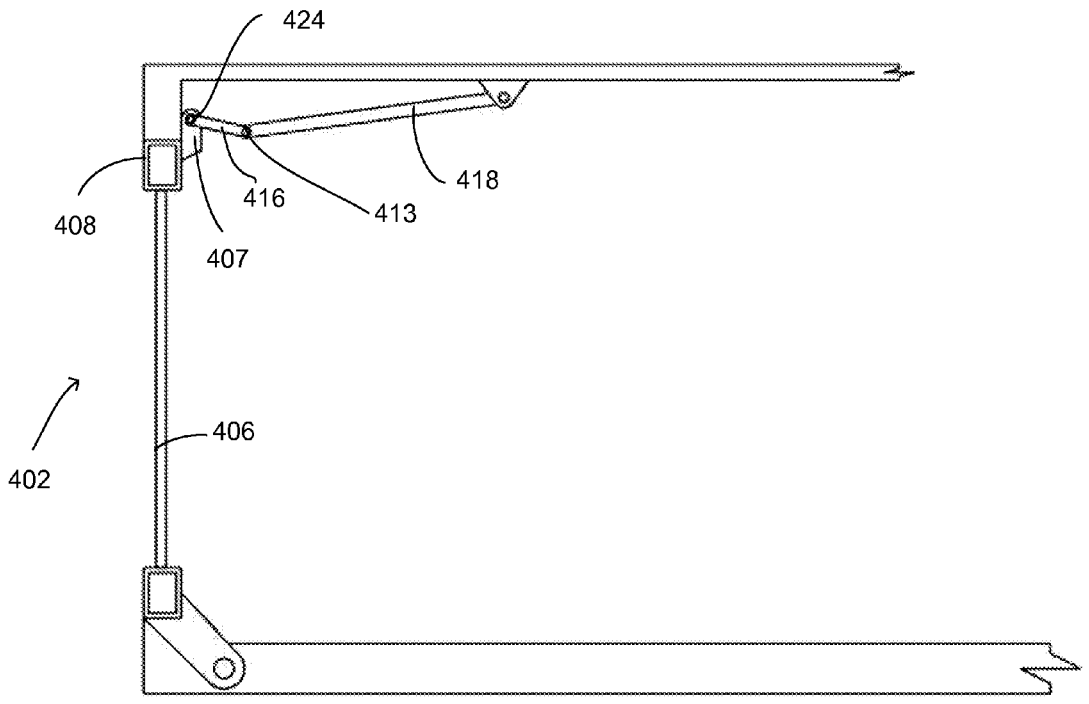
FIG. 4*a* illustrates another embodiment of collapsible container in an assembled condition.
Figure 4B:
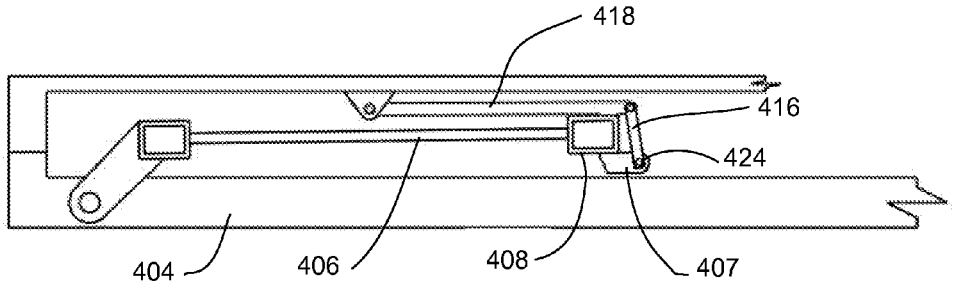
FIG. 4*b* illustrates the container of FIG. 4*a* in a collapsed condition.

Referring to FIGS. 4*a*, by extending the bracket 407, so that the axis of articulation of the hinge 424 is above the upper tubular member 408 of the wall 406, a straight first rigid link 416 may be used. FIG. 4*b* shows the container in a fully collapsed condition. The modified position of the hinge 424, due to the extended bracket 407 ensures that neither the first nor second rigid link 416, 418 fouls the wall 406 in the collapsed condition, so it is not necessary for the first rigid link 416 to be L-shaped, bent or arcuate or otherwise to be provided with a cut out or recess. The extended bracket 407 and corresponding straight first rigid link 416 may be used as an alternative to the L-shaped link in the other embodiments of collapsible container which follow.

Figure 5A:
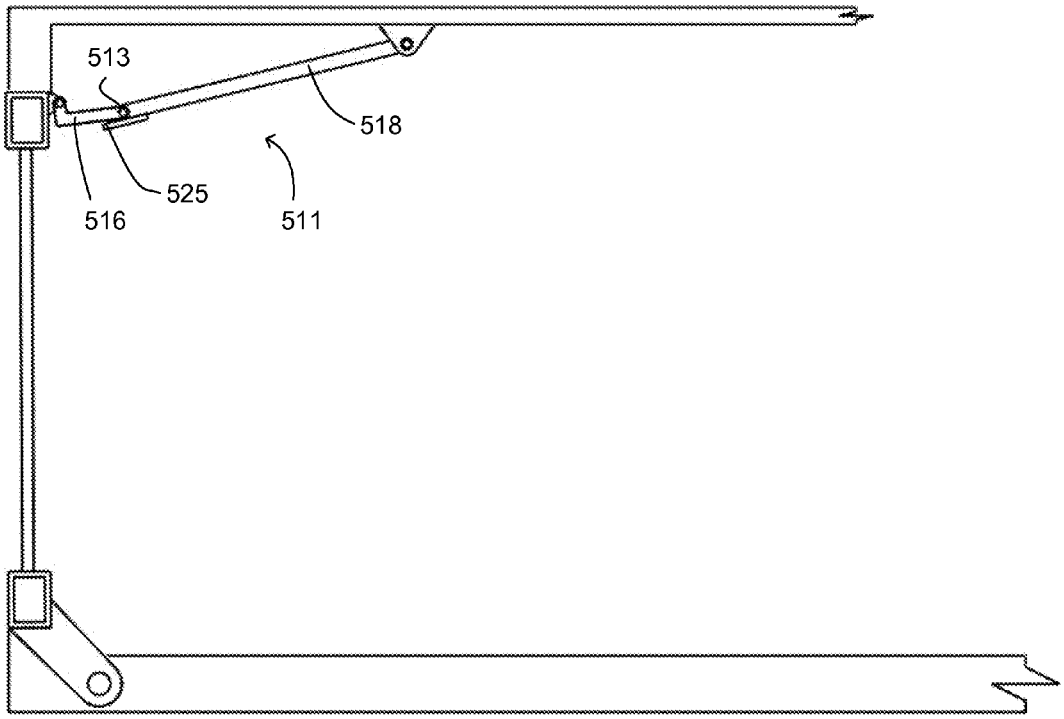
FIG. 5*a* illustrates a modified connecting linkage in a fully assembled condition.
Figure 5B:
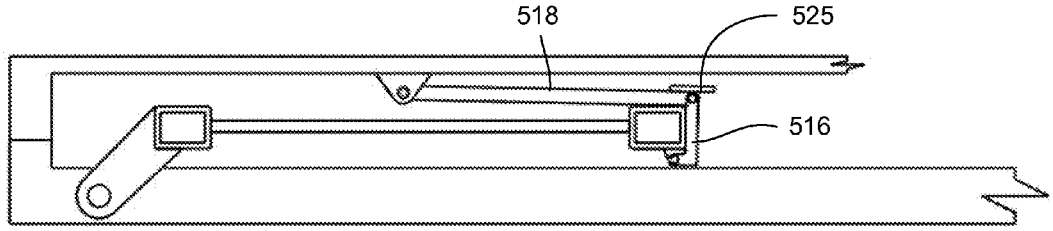
FIG. 5*b* illustrates the modified connecting linkage of FIG. 5*a* in a collapsed condition.

FIGS. 5*a* and 5*b* illustrate an alternative embodiment of connecting linkage 511 in fully assembled and collapsed condition, respectively. This connecting linkage 511 may be used in any embodiment of collapsible container.

The connecting linkage 511 is provided with a plate 525 which is fixed to the connecting linkage 511 by any appropriate means, such as welding. The plate 525 is fixed to a lower side of the second rigid link 518 and overlaps the first rigid link 516 in the assembled condition of the container. Plate 525 enables the first rigid link to move away from the wall when the container is being assembled. Plate 525 may, for example, prevent the linkage going over-centre in use In an alternative embodiment (not illustrated) the plate 525 may be fixed to the first rigid link 516 and may overlap the second rigid link 518. In this embodiment, the plate 525 would have to be shortened, so that it did not obstruct the roof when the container is collapsed fully.

Figure 5C:
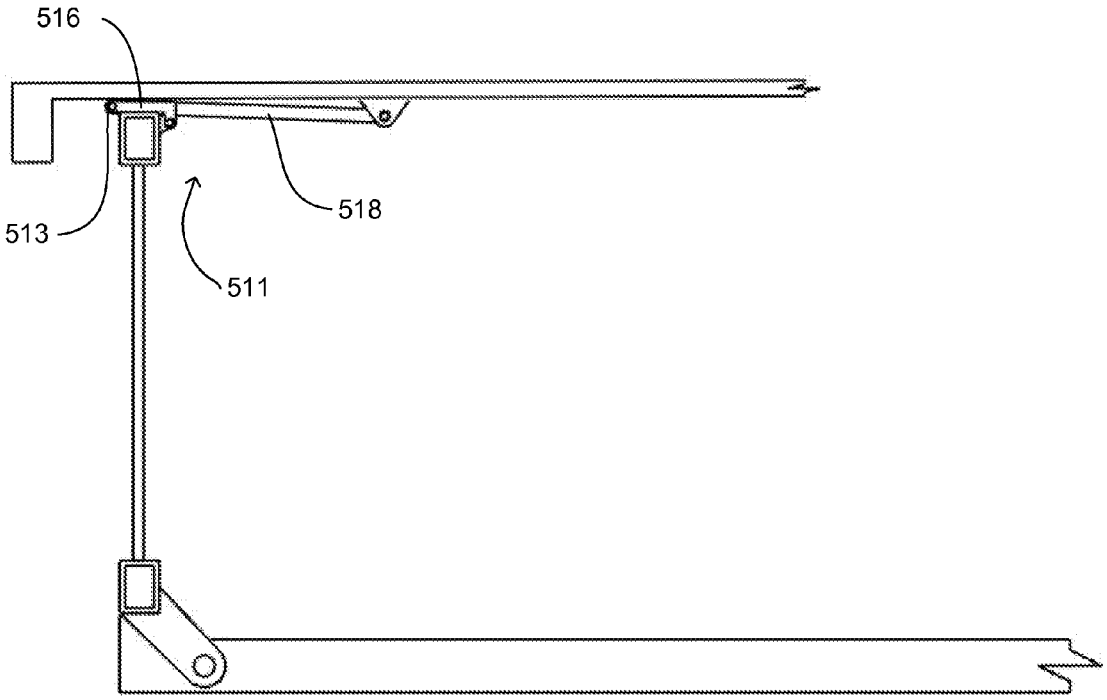
FIG. 5*c* illustrates a possible condition of a container which does not have the modified linkage of the container of FIG. 5*a*.

FIG. 5*c* illustrates what may happen when a plate 525 is not present. When assembling from a collapsed condition as for example illustrated in FIGS. 3*b*, 4*b* and 5*b* to an assembled condition the first rigid link 516 may not move away from the from the side wall and end up between the roof and the wall as illustrated in FIG. 5*c*. This is not desirable.

Plate 525 is preferably present in a design illustrated in FIG. 6 because the problem as described above will more likely occur in such a design.

Figure 6A:
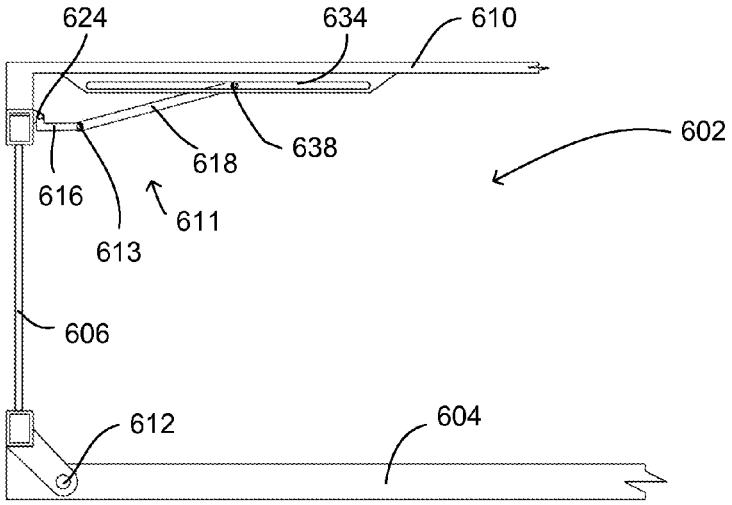
FIGS. 6*a* to 6*c* illustrate another embodiment of collapsible container in progressive stages of collapse from a fully assembled to a fully collapsed condition
Figure 6B:
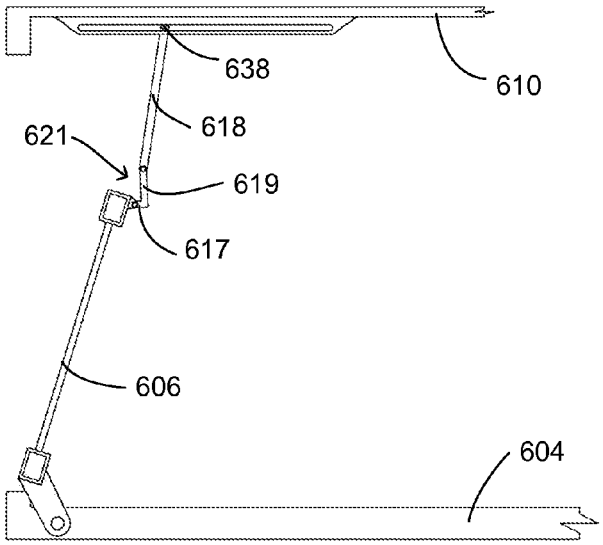
Figure 6C:
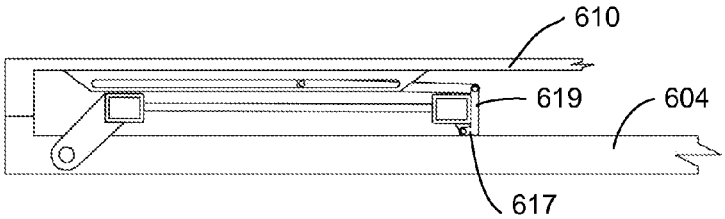

With reference to FIGS. 6*a* to 6*c*, another embodiment of collapsible container 602 comprises a base 604, opposed side walls 606 and a roof 610. The walls 606 are hinged to the base 604 at hinges 612 such that they may rotate about the hinges and fold onto the base 604. The hinges 612 thus define axes of rotation for the walls 606. The roof 610 is connected to the opposed side walls 606 by means of first and second connecting linkages 611, which each comprise a first rigid link 616 rotatably connected to a second rigid link 618 by means of a hinge 613. Each first rigid link 616 is connected by a hinge 624 to a respective second bracket fixed to a side wall 606, and each second rigid link 618 is connected to a pivot pin 638 adapted to be slidably received within a respective slot or channel 634 formed on the roof 610. Each pivot pin 638 may be of any appropriate form suitable for sliding engagement with a slot or rail. For example, the pivot pin 638 may be received directly within the corresponding slot or channel 634, or may be a replaced with a more complex assembly such as a bifurcated yoke (not shown) and may be configured to extend either side of a protruding rail. Similarly, the slots, rails or channels 634 may be of any suitable form. For example, appropriate slots or channels may be formed in the material of the roof 610, or rails may be affixed to the roof 610 for engagement with respective pivot pins 638 as for example described in WO2010151116.

As in the previous embodiments, the first rigid link 616 is substantially L-shaped and comprises a first limb 617 which projects substantially at right angles from the end of a longer second limb 619. A recess 621 is defined between the limbs 617, 619. The first and second rigid links 616, 618 may be formed from any appropriate rigid material and either one may comprise, for example, a metallic tube, channel or bar.

The container of this embodiment is collapsed in the same manner as the embodiment of FIGS. 3*a* to 3*c*. However, because the pivot pin 638 is able to slide along the channel 634 as the roof is lifted there is more laxity in the system, so the roof 610 can be lifted away from the walls 606 by a larger distance without putting undue stress on the connecting linkages 611 or their connections to the walls 606 or roof 610.

The present invention thus provides a collapsible container wherein a large clearance around the connecting members as in the known containers is not required, allowing for reliable sealing between the roof and walls.

The configuration of wall, roof and base as described above and shown in FIGS. 1-6 will typically be part of a collapsible container also comprising two collapsible side walls along its elongated length and a second collapsible wall as for example illustrated in NL1017159. These two elongated and opposed walls are suitably hinged to the base and inwardly rotatable towards the base. The elongated walls will have a greater length than the side walls which are connected to the roof. The containers are suitably so-called 40 or 20 foot containers.

Figure 7A:
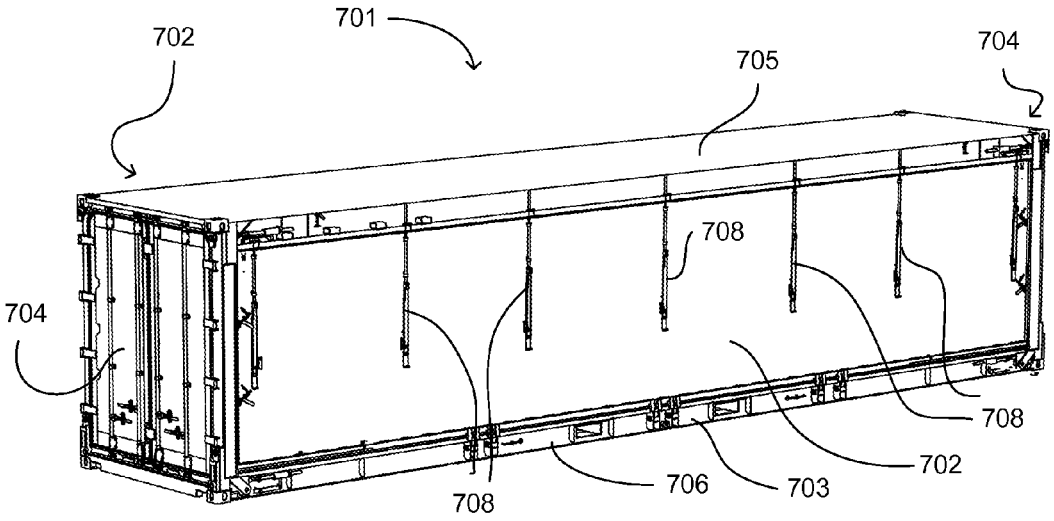
FIGS. 7*a*-7*e* illustrate how the collapsible container may be folded.
Figure 7B:
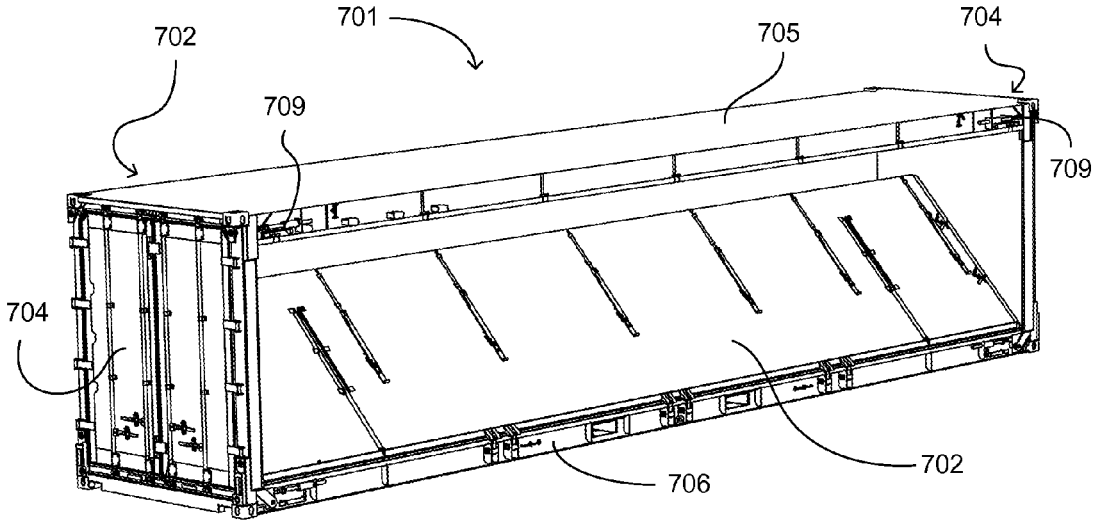
Figure 7C:
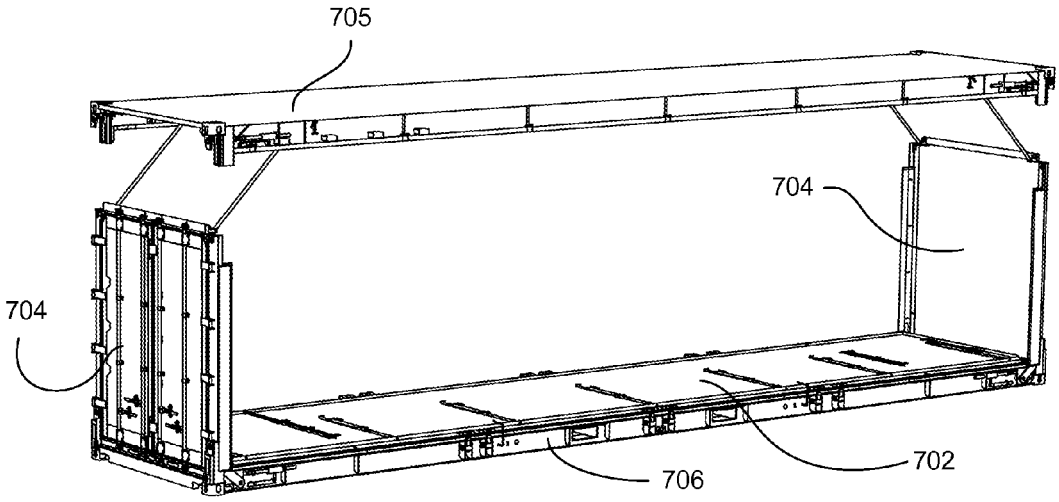
Figure 7D:
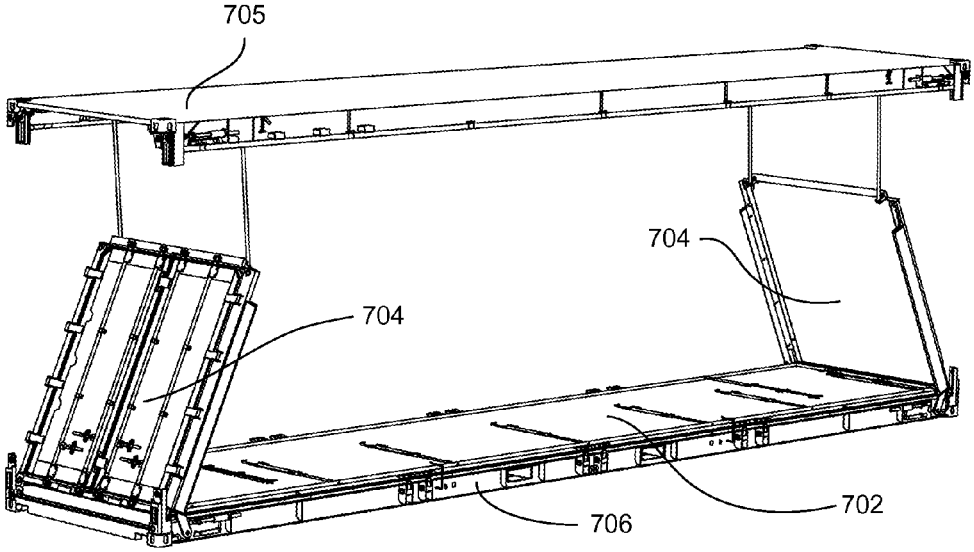
Figure 7E:
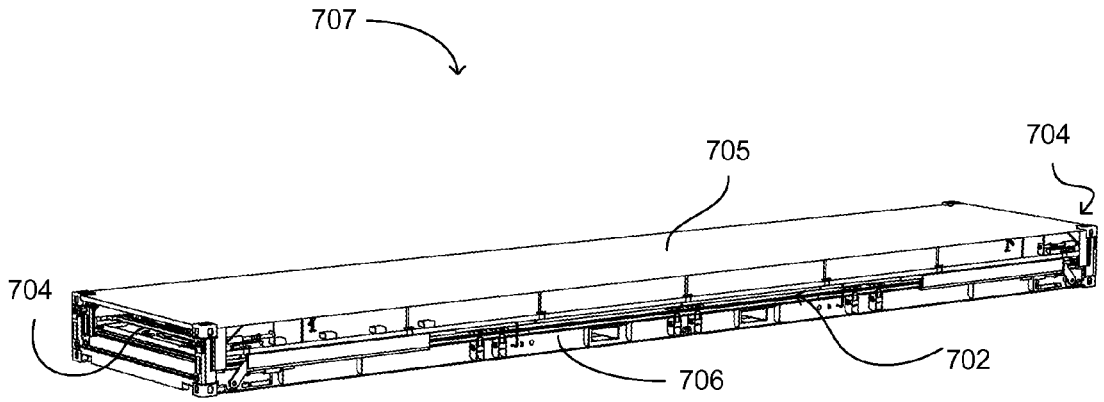

FIG. 7*a-e* illustrates how a collapsible transport container 701 having two collapsible side walls 702 along its elongated length 703 and two opposed side walls 704 connected to the roof 705 is folded from its working state (a) to its collapsed state (e). First the locks 708 are released to disconnect the elongated side walls 702 from the roof 705. Next the elongated side walls 702 are folded inwardly. Next the four locks 709 are released in order to lift the roof 705 as shown in FIG. 7*c*. When the roof 705 is further lifted the side walls 704 pivot inwardly towards the base 706. In FIG. 7*d* it is shown that when the roof 705 is subsequently lowered the side walls 704 collapse onto the already collapsed elongated side walls 702 forming a stack 707 of base 706, two elongated walls 702, side walls 704 and roof 705 shown in FIG. 7*e*. It is possible to stack four stacks 707 and arrive at the same dimensions as one container in its working state (a).

The invention claimed is:

1. A collapsible transport container comprising:

a base;

a roof;

a side wall rotatable relative to the base, the roof being configured to rest on an end of the side wall when the collapsible transport container is in an assembled condition; and a linkage operably connecting the side wall to the roof, the connecting linkage comprising, a first rigid link having a first end rotatably connected to the side wall at or adjacent the end of the side wall, and a second rigid link having a first end rotatably connected to a second end of the first rigid link opposite the first end of the first rigid link and a second end rotatably connected to the roof.

2. The collapsible transport container as claimed in claim 1, wherein:

the first and second rigid links are connected by a hinge, and the first and second rigid links are configured to rotate in the same rotational direction when the collapsible transport container is collapsed from the assembled condition to a collapsed condition.

3. The collapsible transport container as claimed claim 1, wherein the roof is connected to two opposed side walls via the connecting linkage allowing for raising the roof, inward pivoting motion of the side walls towards the base and beneath the roof and then lowering the roof onto the collapsed side walls.

4. The collapsible transport container as claimed in claim 3, wherein the collapsible transport container further comprises two elongated and opposed walls hinged to the base and inwardly rotatable towards the base, which walls have a greater length than the side walls connected to the roof.

5. The collapsible transport container as claimed in claim 1, wherein the first rigid link is provided with a recess which is shaped to accommodate a top of the side wall when the container is in a collapsed condition.

6. The collapsible transport container as claimed in claim 5, wherein the second rigid link is substantially straight.

7. The collapsible transport container as claimed in claim 5, wherein the first rigid link is bent, the recess being defined by the concave face of the bent first rigid link.

8. The collapsible transport container as claimed in claim 7, wherein the first rigid link is L-shaped, the recess being defined between limbs of the L-shaped first rigid link.

9. The collapsible transport container as claimed in claim 1, wherein the first rigid link is attached to a bracket extending from a surface of the side wall facing an interior of the collapsible transport container.

10. The collapsible transport container as claimed in claim 9, wherein the point at which the first rigid link attaches to the bracket is above a top surface of the side wall.

11. The collapsible transport container as claimed in claim 1, wherein means to limit rotation of the first rigid link relative to the second rigid link is present.

12. The collapsible transport container as claimed in claim 1, wherein a plate is fixed to one of the first and second rigid links and overlaps the other of the first and second rigid links.

13. The collapsible transport container as claimed in claim 1, wherein the connecting linkage connects to the roof via a hinge.

14. The collapsible transport container as claimed in claim 1, wherein the connecting linkage connects to the roof at a fixed location.

15. The collapsible transport container as claimed in claim 1, wherein the connecting linkage connects to the roof via a sliding connection.

16. The collapsible transport container as claimed in claim 15, wherein the sliding connection is formed by a pin to which the connecting linkage is attached and which is slidably received within a rail formed on the roof.

17. The collapsible transport container according to claim 1, wherein first and second rigid links are connected by a hinge and wherein the roof is connected to two opposed side walls via the connecting linkage allowing for raising the roof, inward pivoting motion of the side walls towards the base and beneath the roof and then lowering the roof onto the collapsed side walls, and wherein the collapsible transport container further comprises two elongated and opposed walls hinged to the base and inwardly rotatable towards the base, which walls have a greater length than the side walls connected to the roof.

18. The collapsible transport container as claimed in claim 17, wherein the connecting linkage connects to the roof via a sliding connection and wherein the sliding connection is formed by a pin to which the connecting linkage is attached and which is slidably received within a rail formed on the roof.

19. A method of folding the collapsible container as claimed in claim 17, by lifting the roof from the side wall, wherein the side wall or side walls pivot inwardly towards the base and subsequently lowering the roof resulting in that the side wall or side walls further pivot towards the base.

20. The method according to claim 19, wherein the collapsible transport container further comprises two elongated and opposed walls hinged to the base and inwardly rotatable towards the base, which walls have a greater length than the side walls connected to the roof and wherein these two elongated and opposed walls are in turn first pivoted inwardly towards the base before lifting the roof.

* * * * *